US006941686B2

(12) United States Patent
Cusick

(10) Patent No.: US 6,941,686 B2
(45) Date of Patent: Sep. 13, 2005

(54) ADJUSTABLE SIDE PLOW ASSEMBLY

(76) Inventor: Patrick Cusick, 2231 Amber Rd., Marietta, NY (US) 13110

( * ) Notice: Subject to any disclaimer, the term of this patent is extended or adjusted under 35 U.S.C. 154(b) by 0 days.

(21) Appl. No.: 10/683,331

(22) Filed: Oct. 10, 2003

(65) Prior Publication Data

US 2005/0076544 A1 Apr. 14, 2005

(51) Int. Cl.[7] ..... E01H 5/06
(52) U.S. Cl. ..... 37/281
(58) Field of Search ..... 37/266, 234, 236, 37/274, 280, 281; 172/810, 811, 815, 817

(56) References Cited

U.S. PATENT DOCUMENTS

| | | | | | |
|---|---|---|---|---|---|
| 1,880,984 | A | | 10/1932 | Remington | |
| 2,011,777 | A | | 8/1935 | Ritchie | |
| 2,199,593 | A | | 5/1940 | Kaeser | |
| 3,659,363 | A | * | 5/1972 | Snyder | 37/231 |
| 4,744,159 | A | | 5/1988 | Houle | |
| 4,969,280 | A | * | 11/1990 | Thorneloe | 37/281 |
| 5,031,343 | A | | 7/1991 | Houle et al. | |
| 5,048,207 | A | | 9/1991 | Verseef | |
| 5,903,987 | A | | 5/1999 | Nuske | |
| 6,412,200 | B1 | * | 7/2002 | Savard | 37/281 |
| 6,581,307 | B1 | * | 6/2003 | Jones et al. | 37/281 |

* cited by examiner

*Primary Examiner*—Robert E Pezzuto
(74) *Attorney, Agent, or Firm*—Robert J. Sinnema; Bond, Schoeneck & King, PLLC

(57) ABSTRACT

A side plow assembly for use on a vehicle, including a plowshare, the horizontal and vertical positioning which can be controlled independently of each other. The side plow assembly also includes an attachment device that allow it to be quickly attached to and detached from the plow vehicle. The front attachment devices are specifically designed to minimize binding when the plow assembly's plowshare is raised or lowered.

22 Claims, 5 Drawing Sheets

ADJUSTABLE SIDE PLOW ASSEMBLY

FIELD OF THE INVENTION

The present invention relates to snow plows, and more particularly, to an adjustable mounting means for a side-wing plow.

BACKGROUND OF THE INVENTION

It is known to mount a plowshare on the front of a pick-up truck or a utility truck, such as a dump truck. It is further known to mount plowshares on the sides of such vehicles to augment the snow clearing capacity of the front plowshare.

One such device is disclosed in U.S. Pat. No. 5,903,987 to Nüske. Nüske claims a side plow assembly that includes two double-acting hydraulic cylinders connected in series. This circuit, when operated in one direction, concurrently raises the rear of the plowshare and folds it into the side of the vehicle. When operating in the opposite direction, the circuit concurrently lowers the plowshare and extends it away from the side of the vehicle. The side plow assembly of Nüske is controlled by a standard hydraulic circuit that also controls the vehicle's front plow.

A disadvantage of a side plow assembly as disclosed by Nüske, is that one cannot independently adjust the horizontal and vertical position of the side plowshare to accommodate a wide range of conditions. For example, it may be necessary under some circumstances to fully lower the plowshare but only partially extend it away from the side of the vehicle. A further disadvantage of the side plow assembly disclosed by Nüske, is that it uses the vehicle's towing attachment as the rear point of attachment for the plowshare. In this way, the vehicle is prevented from towing a trailer when the plow assembly is attached.

Finally, Nüske discloses a simple connection between the front of the plowshare and the plowing vehicle. Specifically, Nüske describes a vertical axle attached to the plowshare and extending through an opening in a fitting attached to the vehicle. Such an arrangement is subject to binding when the plowshare is raised or lowered and when the plowshare contacts an obstacle during plowing.

What is needed is a side plow assembly that is fully adjustable and that allows the plowing vehicle unrestricted use of its towing attachment. What is further needed is a side plow assembly that can be easily and quickly mounted to and dismounted from the plowing vehicle. What is further needed is a side plow assembly that does not damage the plowing vehicle if the plowshare strikes an obstacle while plowing. What is finally needed is a side plow assembly that allows limited vertical travel of the plowshare in response to changing terrain elevation, but does not experience binding during vertical movement.

SUMMARY OF THE INVENTION

Accordingly, the present invention discloses a side plow assembly that allows independent adjustment of the plowshare's vertical and horizontal position.

The present invention also discloses rear attachment and extension means that allow the plowing vehicle to maintain unrestricted use of its towing attachment.

The present invention further discloses a side plow assembly that can be easily and quickly mounted to and dismounted from the plowing vehicle by virtue of unique quick release assemblies.

Finally, the present invention discloses a unique front attachment means that permits the plowshare limited free travel in the vertical plane, but prevents binding of the plowshare as it moves.

The side plow assembly disclosed in this invention comprises a plowshare, a front attachment means to connect the plowshare to the plowing vehicle's chassis, a rear extension arm to extend the rear of the plowshare away from the side of the plowing vehicle, a rear attachment means to attach the extension arm to the plowing vehicle's chassis and a hydraulic control system that allows the plowing vehicles operator to control the horizontal and vertical position of the plowshare.

DETAILED DESCRIPTION OF THE INVENTION

Figure 1:
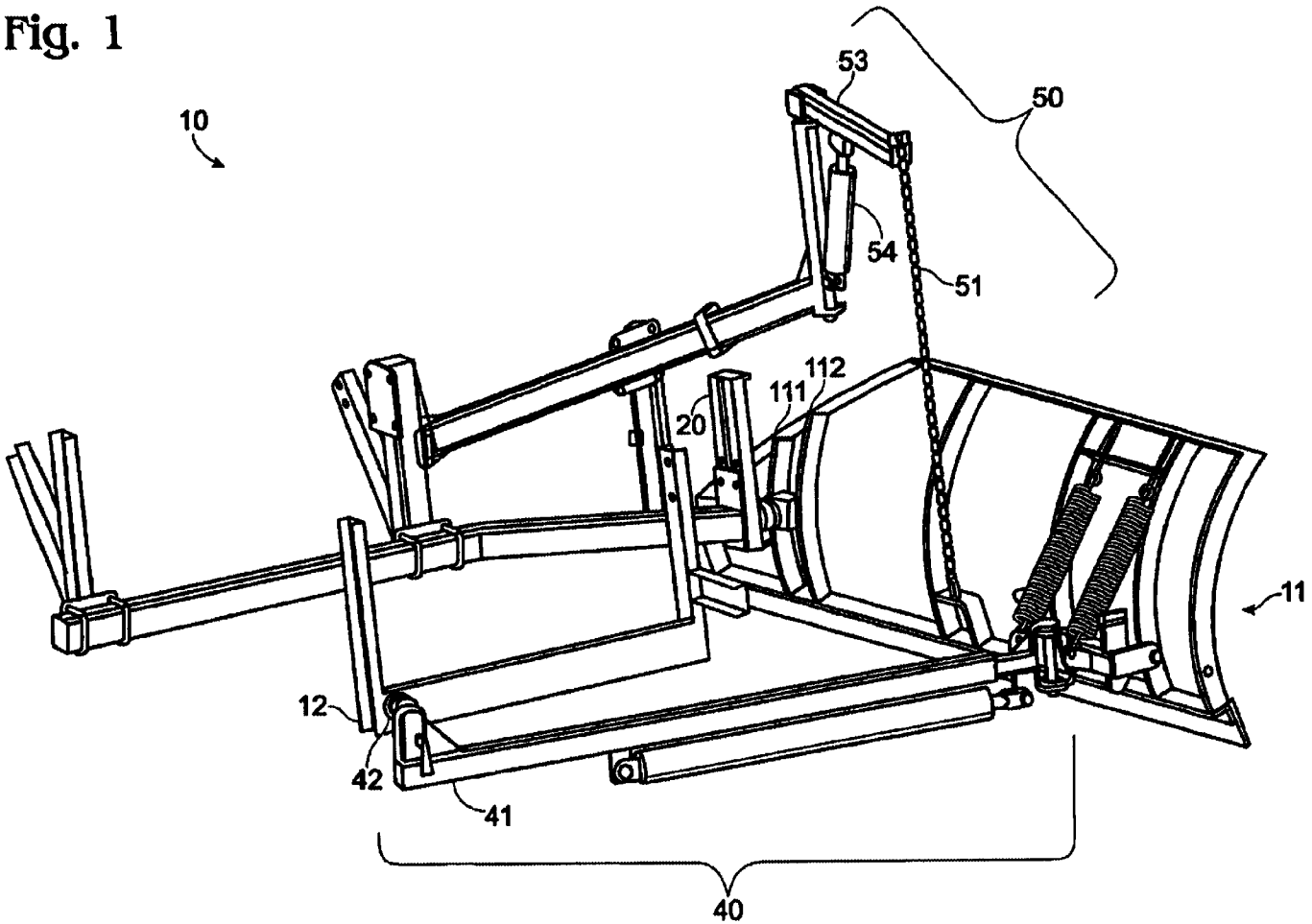
FIG. 1 is a rear elevational view of the side plow assembly mounted to a vehicle.
Figure 2:
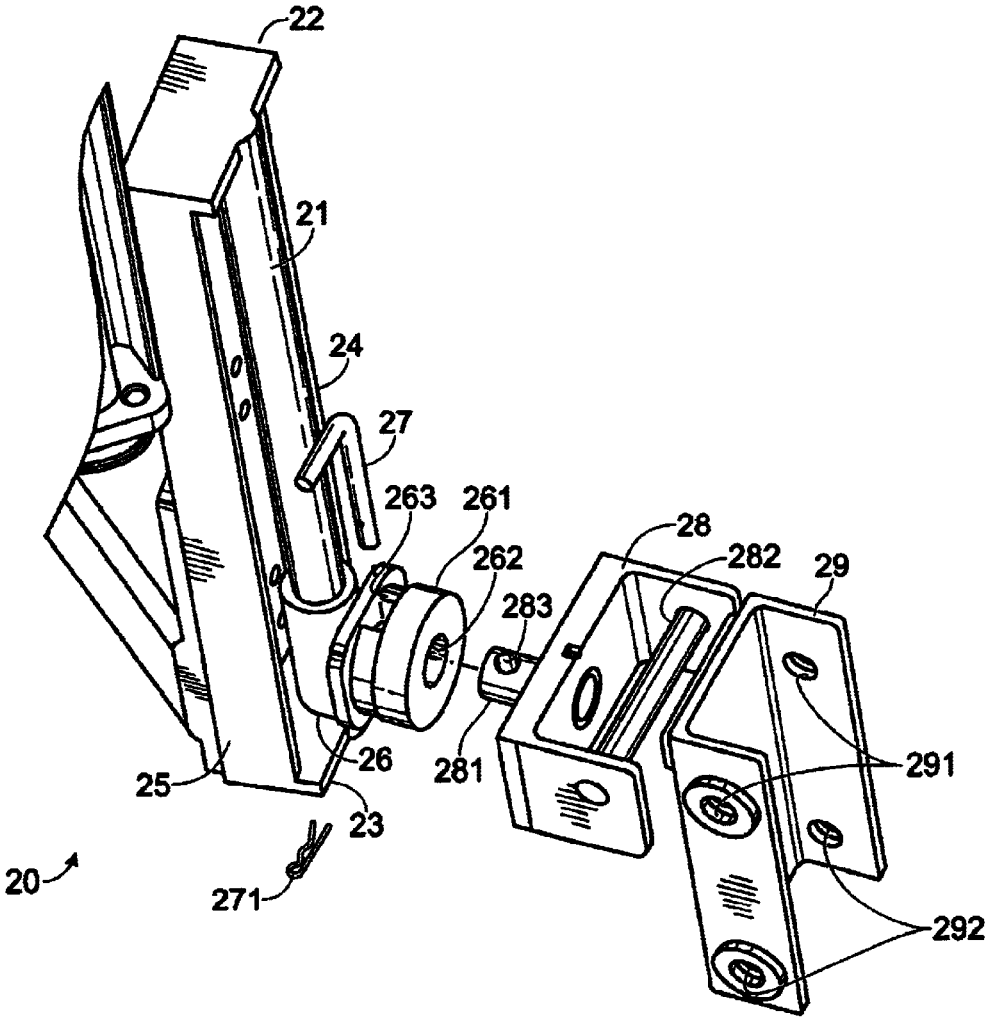
FIG. 2 is an exploded view of the front attachment mechanism.

FIG. 1 shows a side plow assembly 10 as it would be mounted on the right side of a vehicle. Those skilled in the art will recognize that the invention described herein can also be mounted on the left side of a vehicle. The plowshare 4 is attached to the forward part of the vehicle by front attachment means 20 (FIG. 2). An extension means 40, is releasably attached to the plowshare 11. The extension means 40 is releasably attached to the chassis 12 of the vehicle by rear attachment means 42. Lifting means 50 raise and lower the plowshare 11. The assembly further comprises control means to selectively operate the extension means 40 and lifting means 50 to move the plowshare 11 horizontally and vertically relative to the chassis of the vehicle.

As is shown in FIG. 2, the front attachment means 20 consists of a vertical slide bar 21 fixedly attached directly or indirectly to the chassis of the vehicle. The exact location of the front attachment means 20 will be determined by the length of the plowshare 11 and the size of the vehicle; however, any location between the vehicle's rear wheel and front wheel is acceptable. In the preferred embodiment, the vertical slide bar 21 has an upper limit 22, a lower limit 23, and lateral shields 24 and 25. A collar 26 is slidably attached to the vertical slide bar 21 and is capable of limited horizontal rotation about the vertical slide bar 21. In the preferred embodiment, the collar 26 is annular and completely encircles the vertical slide bar 21 and has free rotation of up to approximately 40 degrees around the vertical slide bar 21. Alternate constructions, however, may be substituted as long as the collar 26 is not capable of unintentional disengagement from the vertical slide bar 21. The collar 26 is fixedly attached to a collar mount 261. The collar mount 261 has a lug socket 262 in its horizontal face which receives a mounting yoke locking lug 281. The collar mount 261 also has a locking slot 263, capable of receiving a locking pin 27. The locking pin slot 263 allows the locking pin 27, when inserted, to rotate up to approximately 20 degrees relative to the vertical axis of the vertical slide bar 21.

The front attachment means 20 has retention means, preferably a locking slot 263 and locking pin 27 that securely retain the mounting lug 281 in the lug socket 262, but also allow it limited rotation. Locking pin 27 can be easily removed and replaced to allow the side plow assembly 10 to be dismounted from the plowing vehicle. A mounting lug 281 on the face of the mounting yoke 28 is sized to fit loosely in the lug socket 262. The mounting lug 281 has a pin receiving hole 283 for receiving the locking pin 27 and retaining it in the mounting bracket 261. A wobble plate 29 is attached to the rear surface of the plowshare 11 by means of a bolt or pin that passes through ribs 111 and 112 on the rear surface of the plowshare 11 (FIG. 1) and through mounting holes 292 in wobble plate 29. The bolt or pin passes through holes in the mounting yoke 28, such that the mounting yoke 28 is securely attached to the wobble plate 29 but also such that the vertical plane of the wobble plate 29 can rotate up to approximately 15 degrees relative to the vertical axis of the vertical slide bar 21. This arrangement allows the plowshare 11 to rotate horizontally about the front attachment means 20 at the same time as the plowshare 11 is being raised and lowered, without binding in the front attachment means 20. Similarly, when the plowshare 11 strikes an obstacle while the vehicle is in motion, this arrangement allows limited rotation of the plowshare 11 about its axis, without causing binding in the front attachment means 20.

Figure 3:
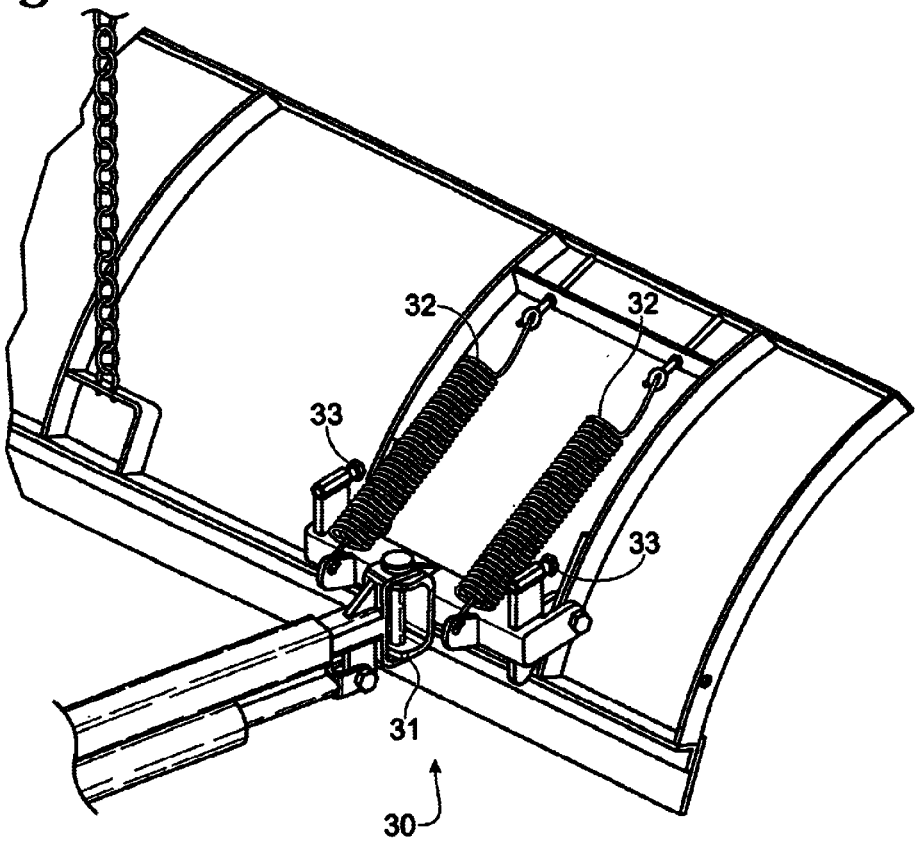
FIG. 3 is a view of the point of attachment between the extension means and the plowshare.

As seen in FIG. 3, the means of attachment 30 between the extension means 40 and the plowshare 11 preferably comprises a modified universal joint 31. This allows the plowshare 11 to rotate horizontally and vertically relative to the extension means 40. Those skilled in the art will recognize that other means of attachment are interchangeable for a universal joint 31, such as a ball joint. In the preferred embodiment of the invention, the attachment means 30 further comprises coiled springs 32 to absorb shocks to the plowshare 11, resulting from minor obstacles in the surface being plowed. The attachment means 30 further comprises adjustable stops 33 to allow adjustment of the angle of the plowshare 11 relative to the surface being plowed.

Figure 4:
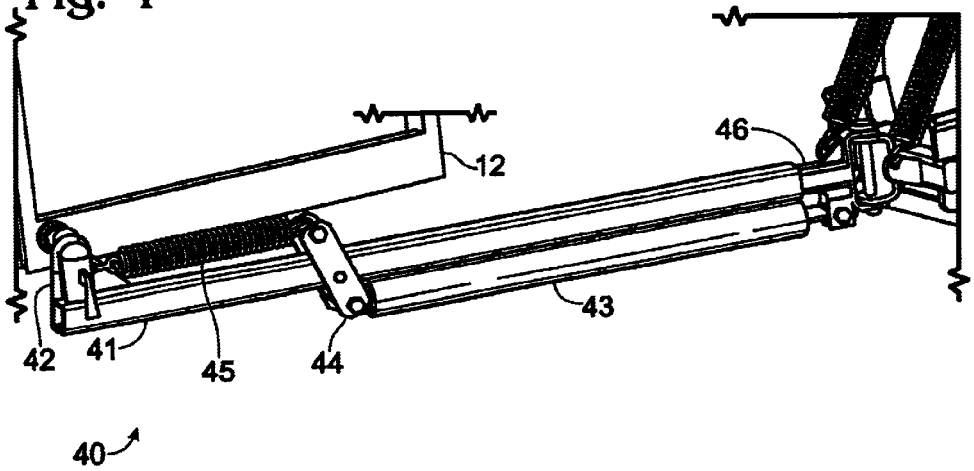
FIG. 4 is a view of the extension means in the preferred embodiment of the invention.

As is seen in FIG. 4, the extension means 40 comprises a telescoping bar first section 41, slidably communicating with a telescoping bar second section 46. Preferably, the telescoping bar first section 41 and telescoping bar second section 46 are constructed of hollow square steel stock approximately 2½ inches across. The telescoping bar second section 46 is sized to fit within, and slidably communicate with, the telescoping bar first section 41. Alternately, the telescoping bar first section 41 can be sized to fit within, and slidably communicate with, the telescoping bar second section 46.

The telescoping bar first section 41 is fixedly attached to rear attachment means 42. In the preferred embodiment, the rear attachment means 42 is a trailer hitch coupler sized to fit a trailer hitch ball attached to the vehicle chassis 12. Using a trailer hitch receiver and ball allows the extension means 40 to be quickly and securely attached to the vehicle chassis 12. Those skilled in the art will recognize that other means of attaching the extension means 40 to the vehicle chassis 12 are within the scope of this invention.

The extension means 40 further comprises extension arm 43. In the preferred embodiment the extension arm 43 is a hydraulic cylinder fixedly attached at its first end to the telescoping bar second section 46 and attached at its second end to the telescoping bar first section 41 by means of a shock damping connection. The extension means 40 is adjustable to extend the plowshare 11 away from the plowing vehicle at an angle that is selected by the operator. The shock damping connection serves to protect the plow assembly and vehicle by absorbing and dissipating a portion of the impact transmitted by the plowshare 11 if it strikes an obstacle while plowing is in progress. In the preferred embodiment the shock damping connection consists of a pivot arm 44 rotatably attached approximately at its midpoint to the telescoping bar first section 41. One end of the pivot arm 44 is hingedly connected to the extension arm 43. The opposite end of the pivot arm 44 is attached to a first end of shock damper 45. In one embodiment the shock damper 45 is a vehicle shock absorber that is connected at its second end to the telescoping bar first section 41 such that the shock damper 45 is forced to compress if the extension means 40 receives a compressing shock that exceeds the compression capacity of the extension arm 43. In an alternate embodiment, shock damper 45 is a spring or vehicle shock absorber that is connected at its second end to the telescoping bar first section 41 and at its first end to the pivot arm 44 such that the shock damper 45 resists extension if the extension means 40 receives a compressing shock that exceeds the compression capacity of the extension arm 43. Those skilled in the art will recognize that other means of damping impact shock are within the scope of this invention.

In the preferred embodiment, the assembly includes means, such as a steel brace attached to the vehicle chassis, that limit upward movement of the plowshare 11. In installations without such means, it is possible for the plowshare 11 to be forced upward by contact with an obstacle and, as a result, contact the body of the vehicle or critical vehicle components. Means of limiting the upward movement of the plowshare 11 will prevent damage to the vehicle body and vital vehicle components. Preferably, such means is positioned such that it contacts the telescoping bar first section 41 or telescoping bar second section 46 when the plowshare is at the highest safe location.

The preferred embodiment also contains an indicator system to signal to the plow operator that the plow has been extended. At a minimum such a system would include a sensor to detect extension of telecscoping bar first section 41 and telescoping bar second section 46 and to generate a signal, a means of communicating the signal to the vehicle cab, and a means, such as a light, to indicate that the telescoping bar first section 41 and telescoping bar second section have been at least partially extended. More elaborate indicator systems will be evident to those skilled in the art, including ones that indicate the degree of extension of the telescoping bar sections 41 and 46.

Figure 5:
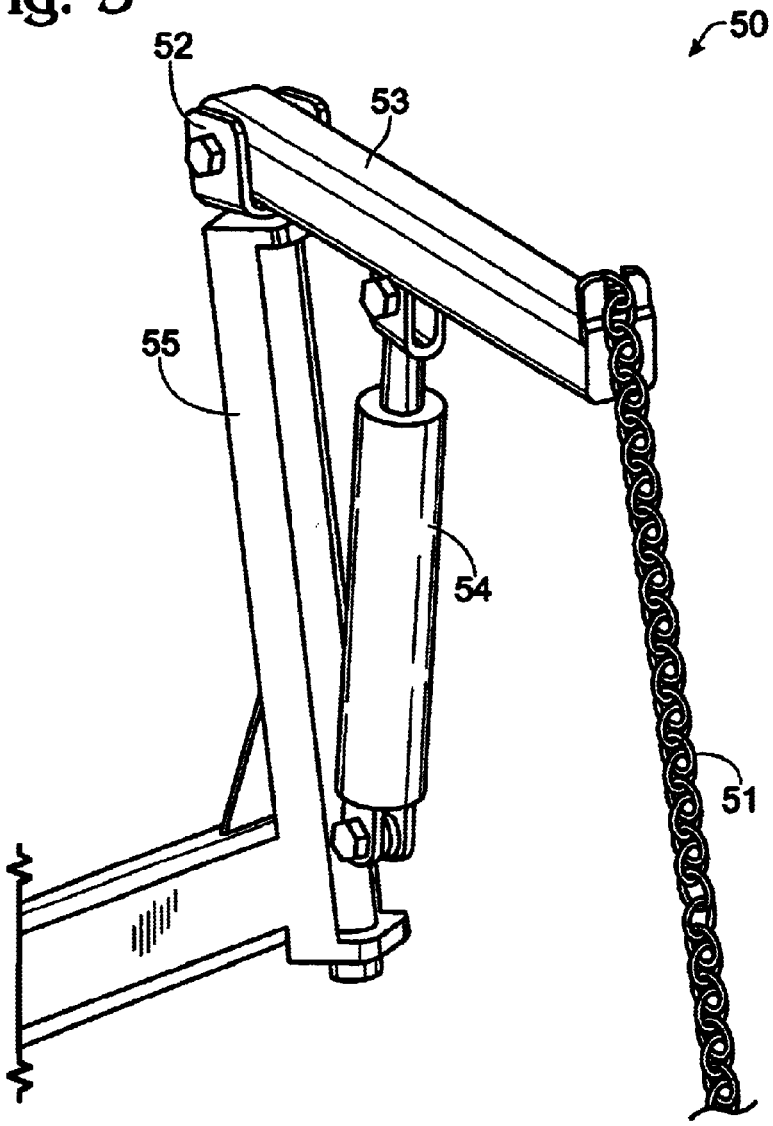
FIG. 5 is a view of the lifting means in the preferred embodiment of the invention.

As is seen in FIG. 5, the lifting means 50 comprises a lifting bar 53. The lifting bar 53 is preferably made of hollow square steel, approximately 2 inches across. In the preferred embodiment, the second end of the lifting bar 53 is attached to a first end of chain 51. The second end of chain 51 is attached to the plowshare 11. In an alternate embodiment a cable or bar may be substituted for the chain 51.

Figure 6:
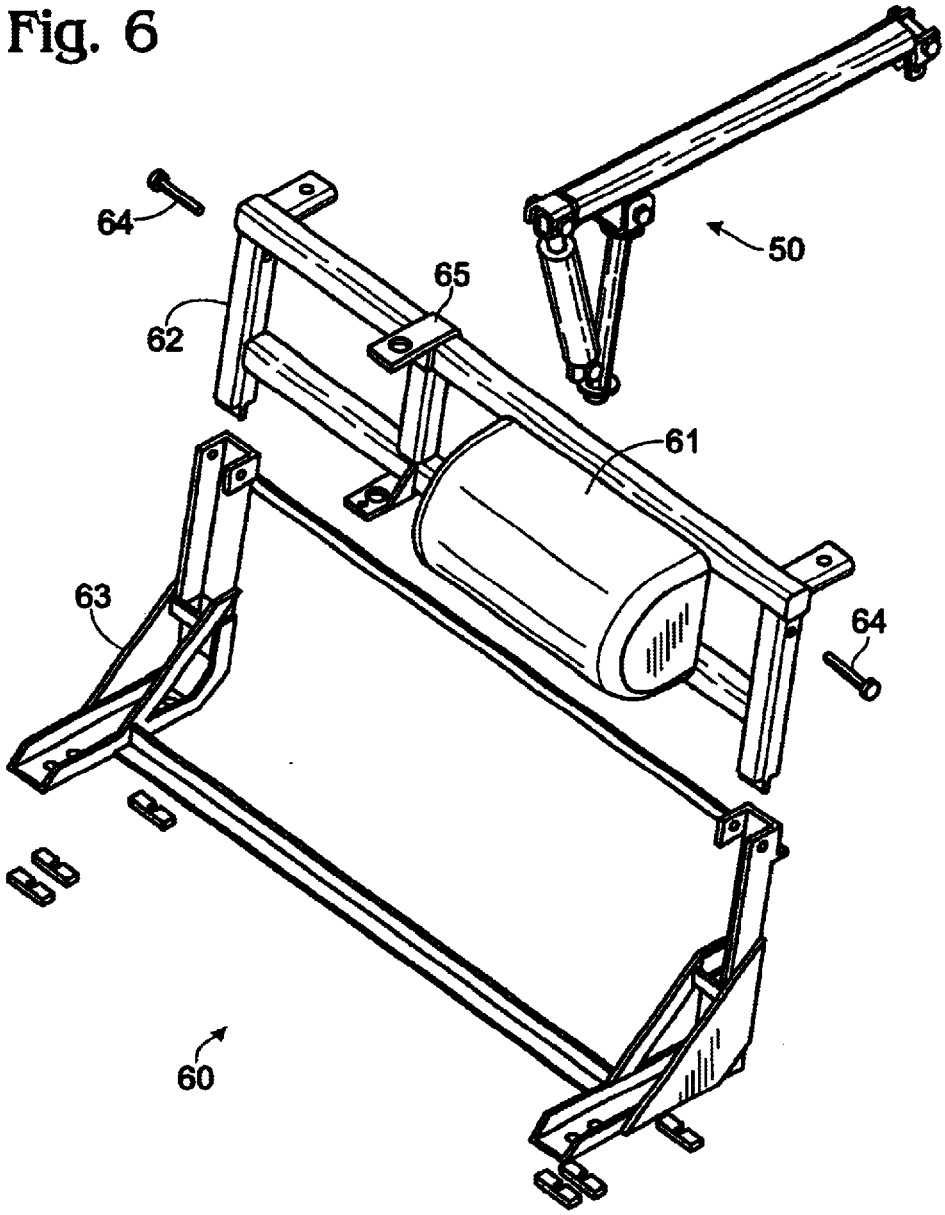
FIG. 6 is an exploded view of the control means in the preferred embodiment of the invention.

The lifting means 50 further comprises a hydraulic cylinder 54 that is hingedly attached at its first end to the lifting bar 53 and attached at its second end to the mounting post 55. The mounting post 55 is attached at its upper end to the first lifting bar 53 by means of a rotating yoke 52 and, in one embodiment, is attached at its lower end to the vehicle chassis (not shown). Alternately, the mounting post 55 can be attached to the removable frame 62 (FIG. 6). In an alternate embodiment the lifting bar 53 is comprised of two sections of hollow steel, sized such that the inner dimensions of the first section are slightly larger than the outer dimensions of the second section, allowing the second section to slide within the first section. In this way, the length of lifting bar 53 can be selectively fixed, for example, by inserting a pin or bolt through holes formed at regular intervals in the sides of the first section of lifting bar 53 and communicating with holes in the sides of the second section of lifting bar 53.

Preferably, the first end of hydraulic cylinder 54 is attached to the lifting bar 53 between the rotating yoke 52 and the second end of the lifting bar 53, such that extension of the hydraulic cylinder 54 raises the second end of the lifting bar 53. In an alternate embodiment, the first end of hydraulic cylinder 54 is attached to the first end of the lifting bar 53 and the rotating yoke 52 is attached to the lifting bar 53 at a location between the first and second ends of the lifting bar 53. In this embodiment, retraction of the hydraulic cylinder 54 raises the second end of the lifting bar 53.

Because the lifting bar 53 is attached to rotating yoke 52, the lifting bar 53 is capable of rotating relative to the vehicle chassis. It is thus able to follow the lateral movement of the plowshare 11 as it extends away from the side of the vehicle, without substantially affecting the height of the plowshare 11 above the ground. In addition, when the plowshare 11 is removed from the vehicle, for example during seasons or periods when snowfall is unlikely, the lifting bar 53 can be rotated to a position parallel to the vehicle's direction of travel and locked in position using, for example, a pin, so that it does not protrude excessively from the side of the vehicle. Alternately, the lifting bar 53, through the rotating yoke 52, can be connected to a torsion spring to urge the lifting bar 53 into a position parallel to the vehicle's direction of travel. When the plow is in use, the lifting bar 53, through the rotating yoke 52, can be limited to a range that is generally perpendicular to the vehicle's direction of travel, for example by use of a fixed pin that prevents rearward rotation of the rotating yoke 52. Alternatively, the strength of the torsion spring can be selected such that the weight of the plowshare 11 is sufficient to maintain the lifting bar 53 in a generally perpendicular position when the plow is in use.

As seen in FIG. 6, control means 60 for the side plow assembly 10 comprises a hydraulic pump 61, attached to a removable frame 62. The removable frame 62 is secured to chassis mount 63 using retainers 64. Retainers 64 preferably are pins that slidably communicate with the holes in the removable frame 62 and with corresponding holes in the chassis mount 63. Acceptable alternatives will be known to those skilled in the art. The chassis mount 63 is attached to the vehicle using permanent or semi-permanent connections, such as bolts or welds, as is known in the art. Preferably, the removable frame 62 has a bracket 65 to which the lifting means 50 can be attached. The lifting means 50, however, can be mounted to the vehicle independent of the removable frame 62. When side plow assembly 10 is mounted on a standard pickup truck, the chassis mount 63 preferably is located in the bed of the pickup truck; when side plow assembly 10 is mounted on another type of utility vehicle, the chassis mount 63 can be mounted in a variety of locations on the vehicle. Those skilled in the art will recognize that the removable frame 62 and chassis mount 63 can be constructed in a variety of shapes, all of which fall within the scope of this invention, provided that the removable frame 62 is capable of being securely fastened to the chassis mount 63 when the plow is in operation and is also capable of being quickly and easily removed from the chassis mount 63 when the plow is not in operation.

The hydraulic pump 61 is connected to hydraulic cylinder 54 and extension arm 43 by hydraulic hoses. The hydraulic pump 61 preferably is operated from the vehicle's driver's seat. The hydraulic pump 61 is capable of extending and retracting hydraulic cylinder 54 and extension arm 43 independently of each other. That is, extension arm 43 can be extended or retracted without the operation of hydraulic cylinder 54, and hydraulic cylinder 54 can be extended or retracted without the operation of extension arm 43. In this way, the plowshare 11 can be precisely positioned for the best operation.

While there has been described and illustrated what is at the present considered to be a preferred embodiment of the invention, it should be appreciated that changes and modifications will likely occur to those skilled in the art. It is intended that the appended claims cover those changes and modifications that fall within the spirit and scope of the disclosed invention.

What is claimed is:

1. A side plow assembly for mounting on a vehicle, comprising:

a) a plowshare;

b) front attachment means to releasably attach said plowshare to the vehicle, said front attachment means including means to prevent binding when the plowshare is raised, said means to prevent binding permitting limited rotation of the plowshare about its longitudinal axis, horizontally approximately about the front attachment means and vertically approximately about the front attachment means;

c) an extension arm having a first end and a second end, pivotably and releasably connected to said plowshare at said extension arm's first end;

d) rear attachment means to releasably attach said extension arm to said vehicle;

e) control means to selectively move the plowshare horizontally and vertically relative to the vehicle.

2. An assembly as claimed in claim 1 wherein said means to prevent binding comprises:

a) a wobble plate hingedly attached to the plowshare;

b) a mounting yoke hingedly attached to the wobble plate;

c) a collar releasably attached to the mounting yoke; and d) wherein said collar is slidably affixed around a vertical slide bar.

3. An assembly as claimed in claim 1 wherein the rear attachment means comprises a trailer hitch ball fixedly attached to the vehicle and a trailer ball receiver fixedly attached to said extension arm's second end.

4. An assembly as claimed in claim 1 wherein the extension arm further comprises shock damping means.

5. An assembly as claimed in claim 1 wherein the extension arm further comprises:

a) a telescoping bar having a first section and a second section;

b) a pivot arm, rotatably attached approximately at its midpoint to said telescoping bar's first section;

c) a hydraulic cylinder attached at its first end to said telescoping bar's first section and attached at its second end to a first end of said pivot arm; and d) a shock damper attached at its first end to a second end of said pivot arm and attached at its second end to said telescoping bar's second section.

6. An assembly as claimed in claim 1 wherein said control means is capable of adjusting said plowshare's horizontal position independently of said plowshare's vertical position.

7. An assembly as claimed in claim 6 wherein the control means comprises extension means attached to said extension arm and lifting means attached to said plowshare.

8. An assembly as claim in claim 7 wherein said control means comprises a hydraulic pump, said extension means comprises a first hydraulic cylinder which operates to extend and retract said extension arm to change the plowshare's horizontal position, and said lifting means comprises a second hydraulic cylinder which operates to raise and lower said plowshare.

9. An assembly as claimed in claim 8 further comprising a chain connected at its first end to said plowshare, and connected at its second end to said lifting means, said lifting means capable of being moved and up and down by said second hydraulic cylinder.

10. An assembly as claimed in claim 9 wherein said lifting means comprises a lever that can be disconnected from said chain and rotated to a secured position when said plowshare is removed from the vehicle.

11. An assembly as claimed in claim 9 further comprising:

a) a removable frame, to which is attached said hydraulic pump;

b) a chassis mount attached to said vehicle for receiving said removable frame;

c) a plurality of retainers for releasably securing said removable frame to said chassis mount; and d) wherein said retainers can be easily removed to allow the said removable frame to be disengaged from said chassis mount when the plow is not in operation.

12. An assembly as claimed in claim 11 wherein said removable frame further comprises a bracket to which said lifting means is attached.

13. An assembly as claimed in claim 1 further comprising a rear brace attached to the vehicle to limit the upward movement of the plowshare.

14. An assembly as claimed in claim 1 further comprising indicator means to indicate extension of said extension arm at a remote location.

15. An assembly as claimed in claim 14 wherein said indicator means is a light that illuminates when said extension arm extends said plowshare horizontally away from the chassis.

16. A vehicle for snow plowing comprising:

a) a side plow assembly, further comprising:

i) a plowshare;

ii) front attachment means to releasably attach said plowshare to said vehicle's chassis;

iii) an extension arm having a first end and a second end, pivotably and releasably connected to said plowshare at said extension arm's first end;

iv) rear attachment means to releasably attach said extension arm to said chassis;

v) control means to selectively move the plowshare horizontally and vertically relative to the vehicle;

b) wherein said front attachment means includes means to prevent binding comprising:

i) a wobble plate hingedly attached to the plowshare;

ii) a mounting yoke hingedly attached to the wobble plate;

iii) a collar releasably and rotatably attached to the mounting yoke;

iv) wherein said collar is slidably and rotatably affixed around a vertical slide bar;

c) wherein said control means is capable of adjusting said plowshare's horizontal position independently of said plowshare's vertical position, said control means comprising:

i) a hydraulic pump;

ii) a first hydraulic cylinder which operates to extend and retract said extension arm to change the plowshare's horizontal position;

iii) a second hydraulic cylinder;

iv) a lift arm which operates to raise and lower said plowshare in response to movement of said second hydraulic cylinder;

v) a removable frame, to which is attached said hydraulic pump;

vi) a chassis mount for receiving said removable frame;

vii) a plurality of retainers for releasably securing said removable frame to said chassis mount; and viii) wherein said retainers can be easily removed to allow said removable frame to be disengaged from said chassis mount when the plow is not in operation.

17. An apparatus for releasably attaching a side mount plowshare to a vehicle, comprising:

a) a vertical slide bar attached to the vehicle;

b) a wobble plate hingedly attached to the plowshare c) a mounting yoke hingedly attached to said wobble plate;

d) a collar slidably and rotatably affixed around said vertical slide bar; and e) a retainer for releasably and rotatably securing said collar to said mounting yoke.

18. An apparatus for adjustably connecting a side mount plowshare to the rear of a vehicle, comprising:

a) a telescoping bar having a first section and second section;

b) connection means for releasably attaching said telescoping bar's first section to the vehicle, said connection means comprising a trailer hitch coupler for attaching to a trailer hitch ball on the vehicle;

c) connection means for attaching said telescoping bar's second section to the plowshare;

d) a pivot arm, rotatably attached approximately at its midpoint to said telescoping bar's first section;

e) a hydraulic cylinder attached at its first end to said telescoping bar's first section and attached at its second end to a first end of said pivot arm; and f) a shock damper attached at its first end to a second end of said pivot arm and attached at its second end to said telescoping bar's second section.

19. Apparatus for controlling the plowshare of a side mount snowplow mounted on a vehicle comprising:

a) a removable frame;

b) a hydraulic pump attached to said removable frame;

c) a chassis mount for receiving said removable frame, said chassis mount fixedly attached to the vehicle; and d) retainers for releasably securing said removable frame to said chassis mount.

20. The apparatus of claim 19 further comprising:

a lift arm for raising the plowshare, said lift arm extending approximately perpendicular to the vehicle's direction of travel when the snow plow is in operation and said lift arm capable of being rotated to, and locked in, a position parallel to the vehicle's direction of travel when the plowshare is temporarily removed.

21. The apparatus of claim 20 wherein the lift arm is attached to the vehicle.

22. The apparatus of claim 20 wherein the lift arm is attached to said removable frame.

* * * * *